US008201592B2

(12) United States Patent
Van Vreeland et al.

(10) Patent No.: US 8,201,592 B2
(45) Date of Patent: Jun. 19, 2012

(54) METHOD AND ARRANGEMENT FOR MAKING UP PREPARATIONS

(75) Inventors: Sander Godfried Van Vreeland, Enschede (NL); Jan Willem Dorpema, Veenendaal (NL)

(73) Assignee: Medical Dispensing Systems B.V., Enschede (NL)

( * ) Notice: Subject to any disclaimer, the term of this patent is extended or adjusted under 35 U.S.C. 154(b) by 1257 days.

(21) Appl. No.: 11/629,147

(22) PCT Filed: Jun. 7, 2005

(86) PCT No.: PCT/NL2005/000410

§ 371 (c)(1),
(2), (4) Date: Nov. 1, 2007

(87) PCT Pub. No.: WO2005/120692

PCT Pub. Date: Dec. 22, 2005

(65) Prior Publication Data

US 2011/0168293 A1 Jul. 14, 2011

(30) Foreign Application Priority Data

Jun. 10, 2004 (NL) ..... 1026375

(51) Int. Cl.
*B65B 1/30* (2006.01)

(52) U.S. Cl. ..... 141/94; 141/9; 141/27; 141/104; 141/145; 700/245

(58) Field of Classification Search ..... 141/2, 9, 141/94, 95, 100–104; 700/245
See application file for complete search history.

(56) References Cited

U.S. PATENT DOCUMENTS

| | | | | |
|---|---|---|---|---|
| 4,842,028 | A * | 6/1989 | Kaufman et al. | 141/114 |
| 5,122,342 | A * | 6/1992 | McCulloch et al. | 422/65 |
| 5,341,854 | A * | 8/1994 | Zezulka et al. | 141/1 |
| 5,431,201 | A * | 7/1995 | Torchia et al. | 141/98 |
| 5,938,080 | A * | 8/1999 | Haaser et al. | 222/144 |
| 6,412,658 | B1 * | 7/2002 | Bartholomew et al. | 222/1 |
| 6,659,142 | B2 * | 12/2003 | Downs et al. | 141/9 |
| 6,672,341 | B2 * | 1/2004 | Bartholomew et al. | 141/18 |
| 6,915,823 | B2 * | 7/2005 | Osborne et al. | 141/27 |
| 6,935,386 | B2 * | 8/2005 | Miller et al. | 141/18 |
| 7,343,943 | B2 * | 3/2008 | Khan et al. | 141/95 |
| 7,610,115 | B2 * | 10/2009 | Rob et al. | 700/245 |
| 7,624,769 | B2 * | 12/2009 | Bartholomew et al. | 141/2 |

* cited by examiner

*Primary Examiner* — Timothy L Maust
(74) *Attorney, Agent, or Firm* — Robert A. Jensen; Jensen & Puntigam, P.S.

(57) ABSTRACT

A method for filling a container (16) with a preparation consisting of a number of components, stored in a number of sub containers (1, 23), placed inside a housing (29). A robot, accommodated inside the housing (29), composes the preparation based upon a supplied prescription and places the sub containers (1,23) containing the components mentioned in the prescription one by one above the container (16) and makes flow out an amount of the respective component as specified by the prescription.

10 Claims, 7 Drawing Sheets

Figure 2:
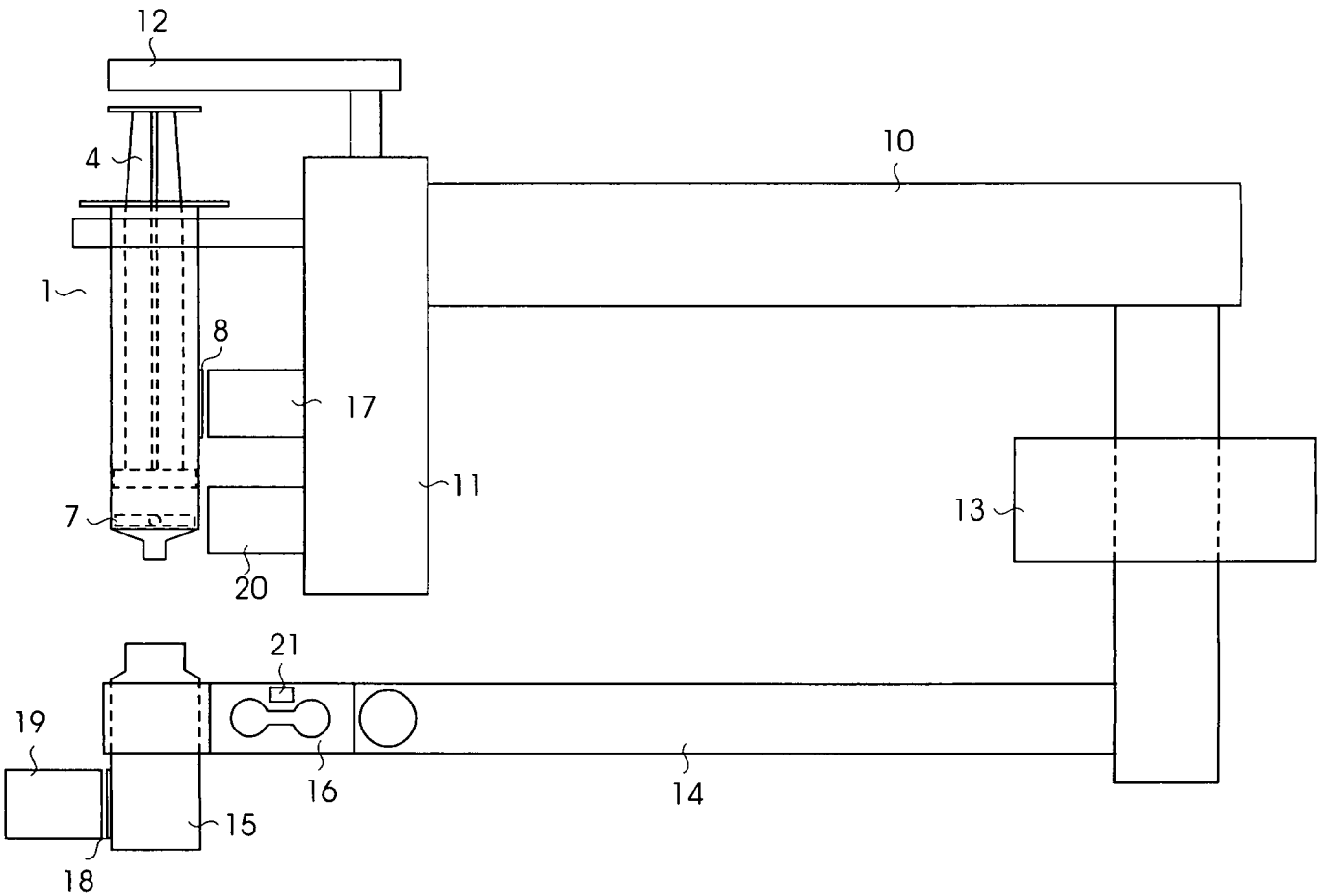

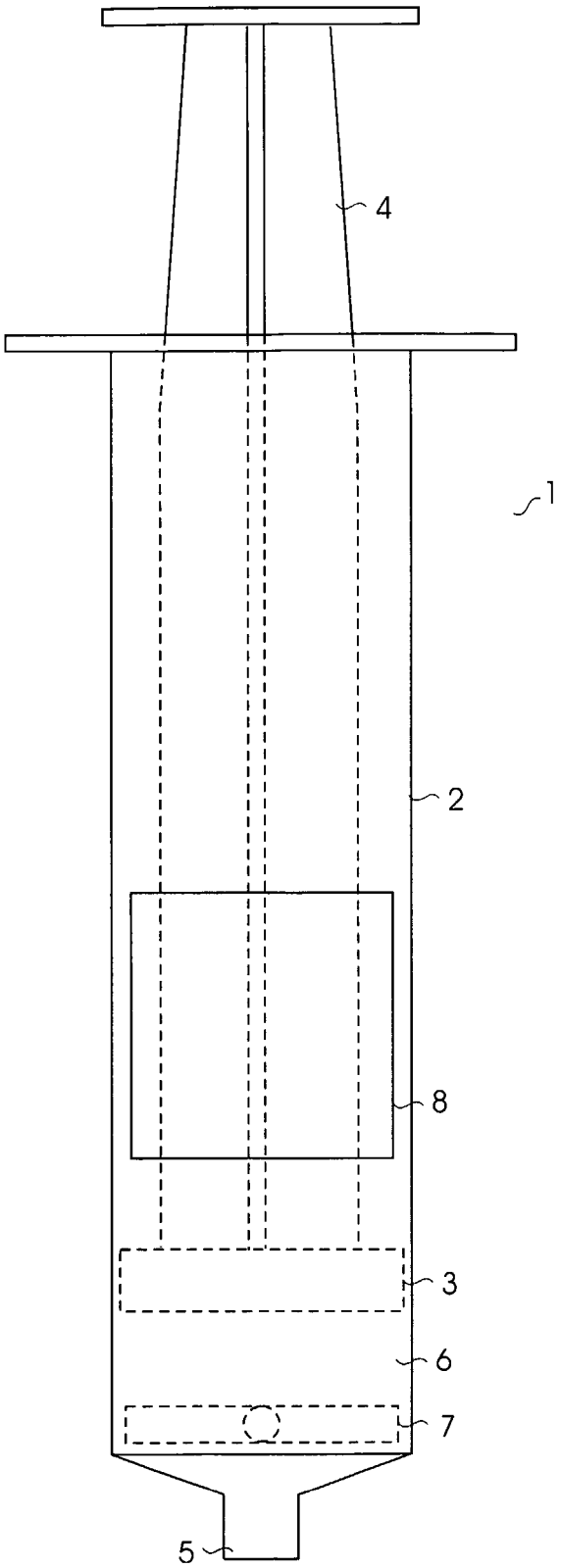
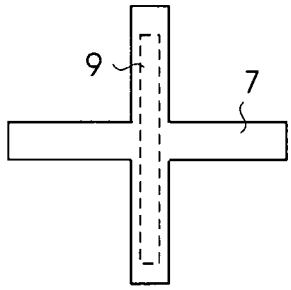
Fig. 1B
Fig. 1A

METHOD AND ARRANGEMENT FOR MAKING UP PREPARATIONS

The invention relates to a method for filling a container with a preparation consisting of a number of liquid components. A method of this kind is for example employed for making up an injection preparation. Usually, a preparation must be made up aseptically, which according to the state of the art takes place by preparing it inside a clean room, by personnel dressed in sterile clothing which are admitted into the clean room via a system of locks. A preparation made in this way is expensive and keeping the clean room clean is difficult. Moreover a monitoring of the composition of the injection preparations is virtually impossible.

The inventive method is characterised in that the components are stored in a series of sub containers, that on the basis of a supplied prescription a robot subsequently selects sub containers containing components mentioned in the prescription and, by making use of an actuator, makes flow out an amount of a component from a selected sub container as specified by the prescription into the container. The inventive method can be performed inside a small, aseptic room, without the intervention of human hands. Moreover, the likelihood of a robot making up a preparation with an incorrect composition is much smaller than the likelihood for a person doing so. For making up a number of preparations, a number of sub containers and a number of containers can be brought inside the aseptic room via an aseptic coupling lock and after the preparation be taken out. Usually, the aseptic room is only sterilized again after being serviced for example. By using coupling locks, it becomes possible to install the arrangement virtually anywhere.

A favourable realisation of the inventive method for which the likelihood of a preparation having a false composition is even further reduced is characterised in that on each sub container an identification label is attached and that the robot reads the identification label with the aid of a reading device before the actuator is actuated. In the unlikely event of a false sub container being positioned above the container, this will be detected by the robot and the production will be stopped and an alarm will be generated for example. The method especially advantageous for making up individual preparations or preparations for specific patients, for which the likelihood of making mistakes is relatively large when the traditional method is used.

A further favourable realisation is characterised in that after the actuator has been actuated the robot writes data to the corresponding identification label with a writing device, so that it is always clear how much of the component in question is still present in the sub container. If an insufficient amount of a specific component is present, the production may be interrupted and an alarm may be generated for example.

A further favourable realisation is characterised in that to each container an identification label is attached and that after making up the preparation the robot writes an identification to the identification label with the writing device, for example the composition of the preparation. It is possible then to determine unambiguously the type of preparation after it has been produced.

A further favourable realisation is characterised in that each container is weighted while being filled and/or after being filled. If an inexplicable difference is found, then all preparations will be destroyed for example and in this way it can be prevented that a possibly incorrect preparation is delivered.

A further favourable realisation is characterised in that after making up a number of preparations, the content of the sub containers is read with the aid of the reading device and compared with the content of the sub containers as expected by the robot. If an inexplicable difference is found, then all preparations will be destroyed for example and in this way it can be prevented that a possibly incorrect preparation is delivered.

A further favourable realisation is characterised in that the sub container is a hypodermic syringe, that the actuator is a pressing device and that before the actuator is actuated a stirring mechanism, present inside the hypodermic syringe is put into action, so that one may be confident of the administered liquid components having a homogeneous composition.

The invention also relates to an arrangement for making up preparations, comprising a number of sub containers, filled with liquid components for preparations and at least one container for receiving the components. According to an aspect of the invention, the arrangement is characterised in that it is accommodated inside a closed housing and is provided with at least one actuator for making components flow out of the sub containers into the at least one container, which implies that the actual making up may take place inside a small aseptic room, while the control of the arrangement may be positioned outside the aseptic room.

A favourable embodiment of the inventive arrangement with which human errors can be excluded when making up preparations is characterised in that the arrangement comprises a robot for operating the at least one actuator and for placing a container under an outlet of an actuator or for placing an outlet from an actuator above a container.

A favourable embodiment with which the making up of the preparations and the inspection of finished preparations can be carefully performed is according to a further aspect of the invention characterised in that the sub containers and the at least one container are each provided with an identification label and that the robot is provided with a reading device for reading an identification label.

A further favourable embodiment with which a mistakenly exchange of containers with finished preparations can be excluded is characterised in that the robot is provided with a writing device for writing onto an identification label.

A further favourable embodiment of the inventive arrangement is characterised in that the robot is provided with a weighing device, for determining a weight of a container, which may be used for controlling an actuator and/or for performing an additional check while filling.

A further favourable embodiment of the inventive arrangement is characterised in that the robot is provided with an input device with which a list of components for a container can be entered. Once a list of components has been entered for a number of containers, the arrangement may fill these containers fully automatic.

A further favourable embodiment of the inventive arrangement is characterised in that a sub container is a hypodermic syringe and the actuator comprises a pressing device.

A further favourable embodiment of the inventive arrangement is characterised in that the arrangement is provided with drive means for a stirring device and that at least some of the hypodermic syringes are provided with a stirring device, so that one may be confident of the administered liquid components having a homogeneous composition.

Figure 3A:
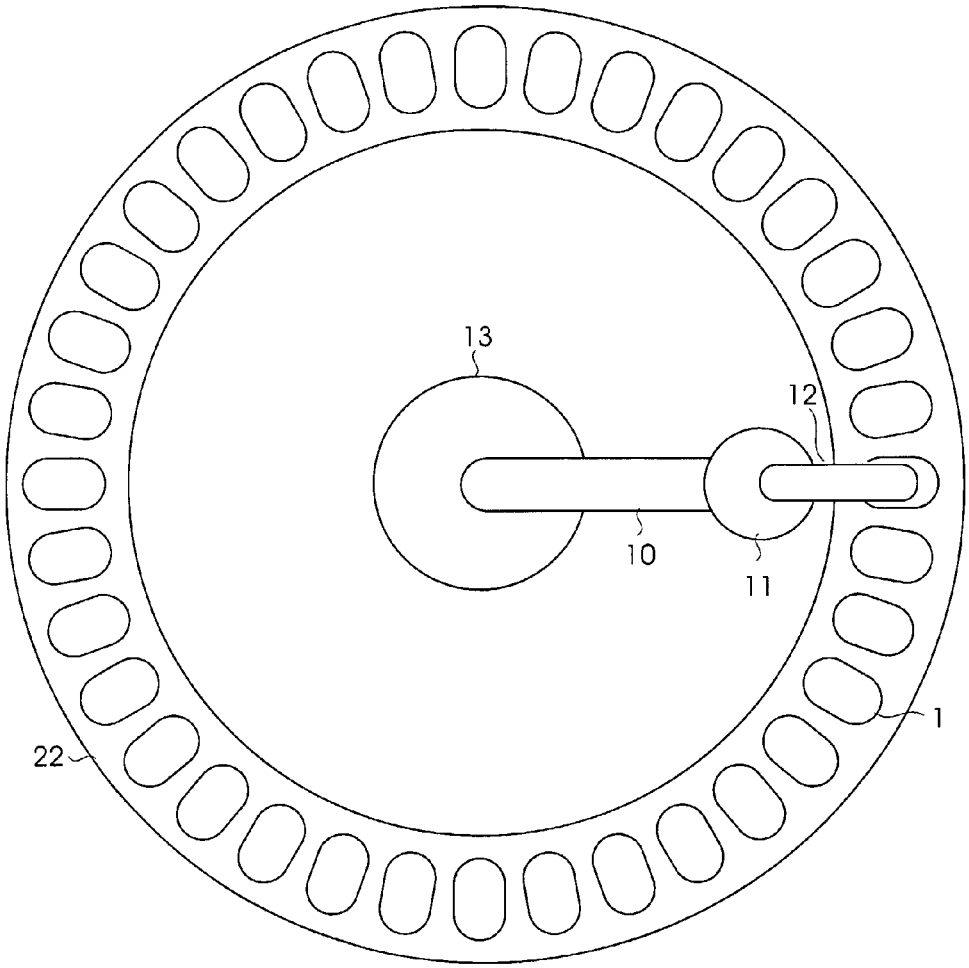
Figure 3B:
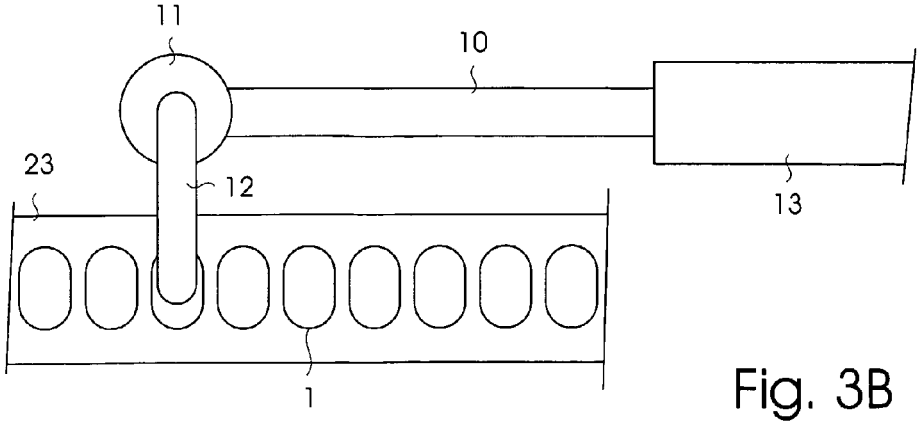
Figure 4:
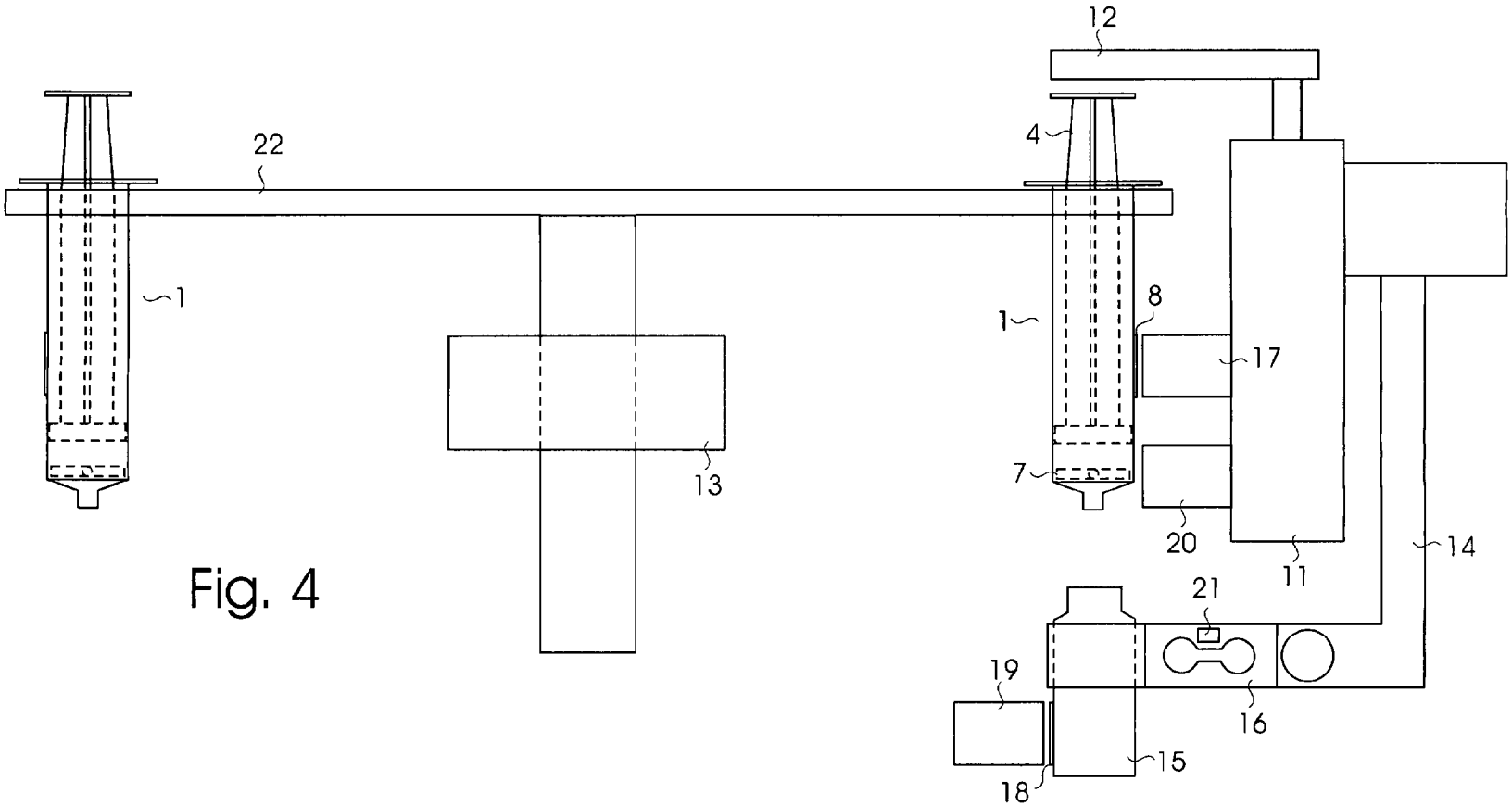
Figure 5A:
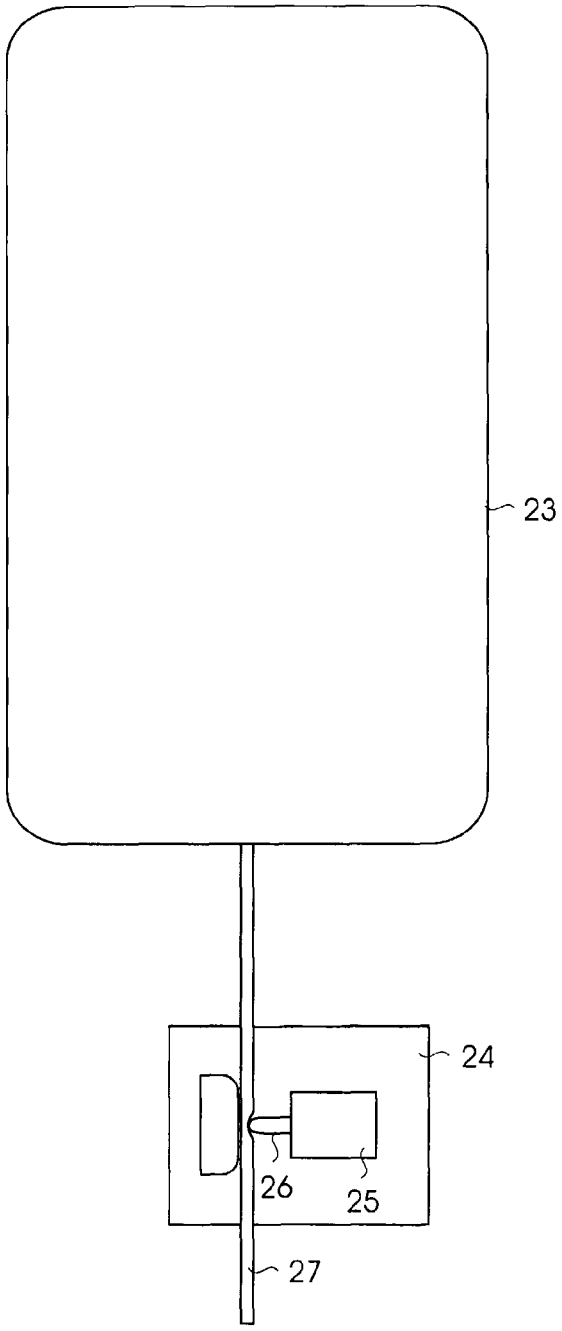
Figure 5B:
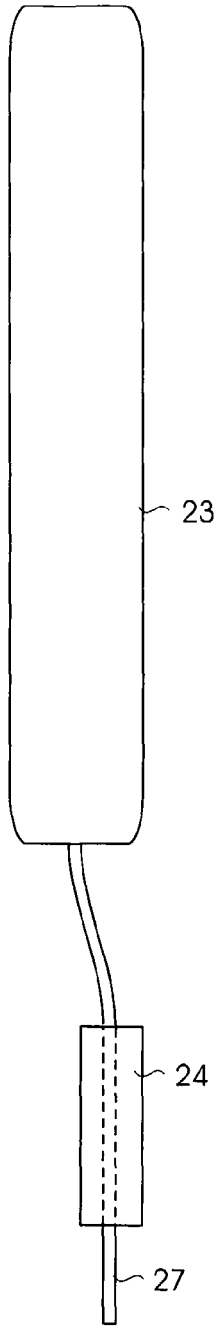
Figure 6:
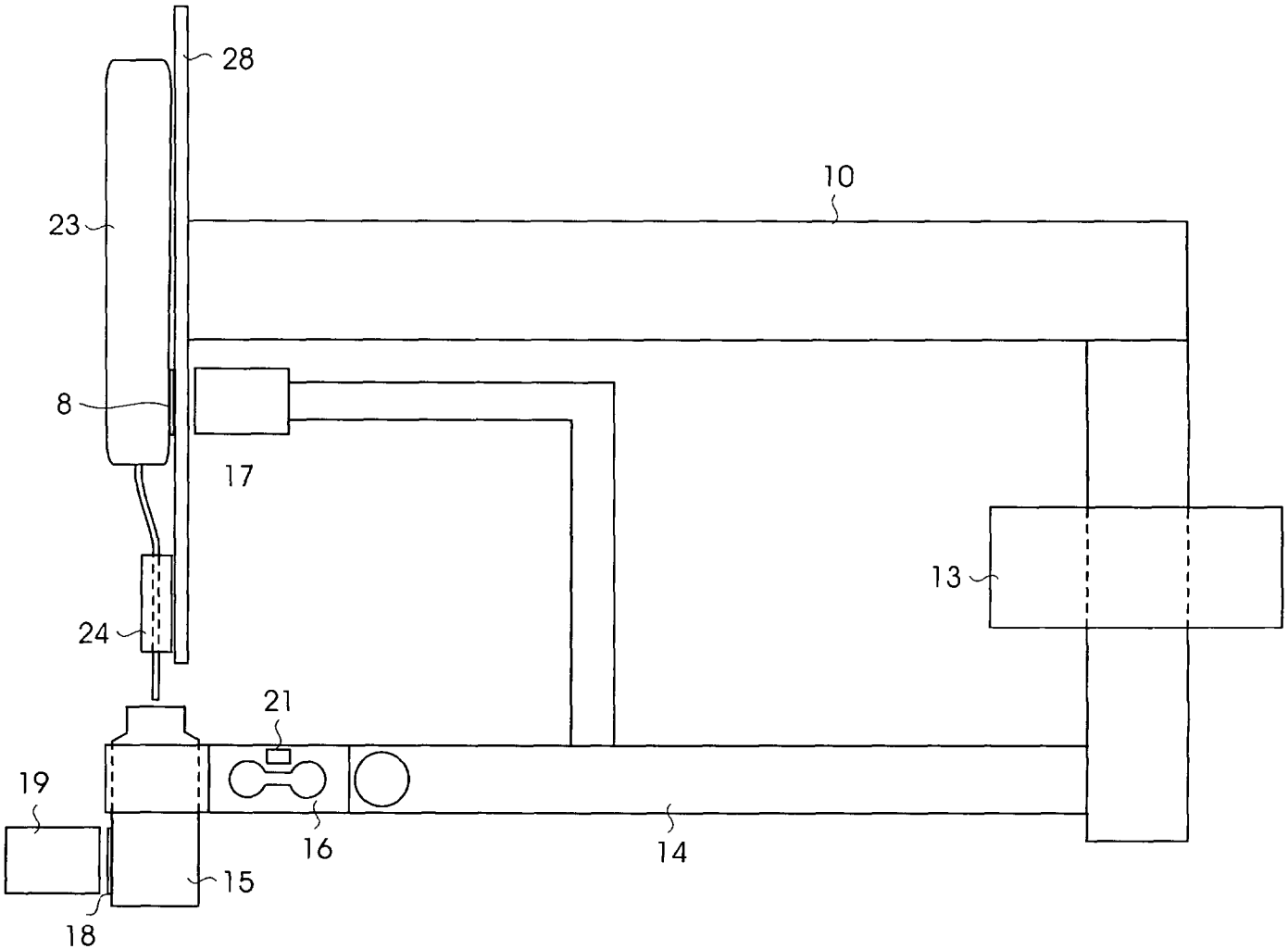
Figure 7:
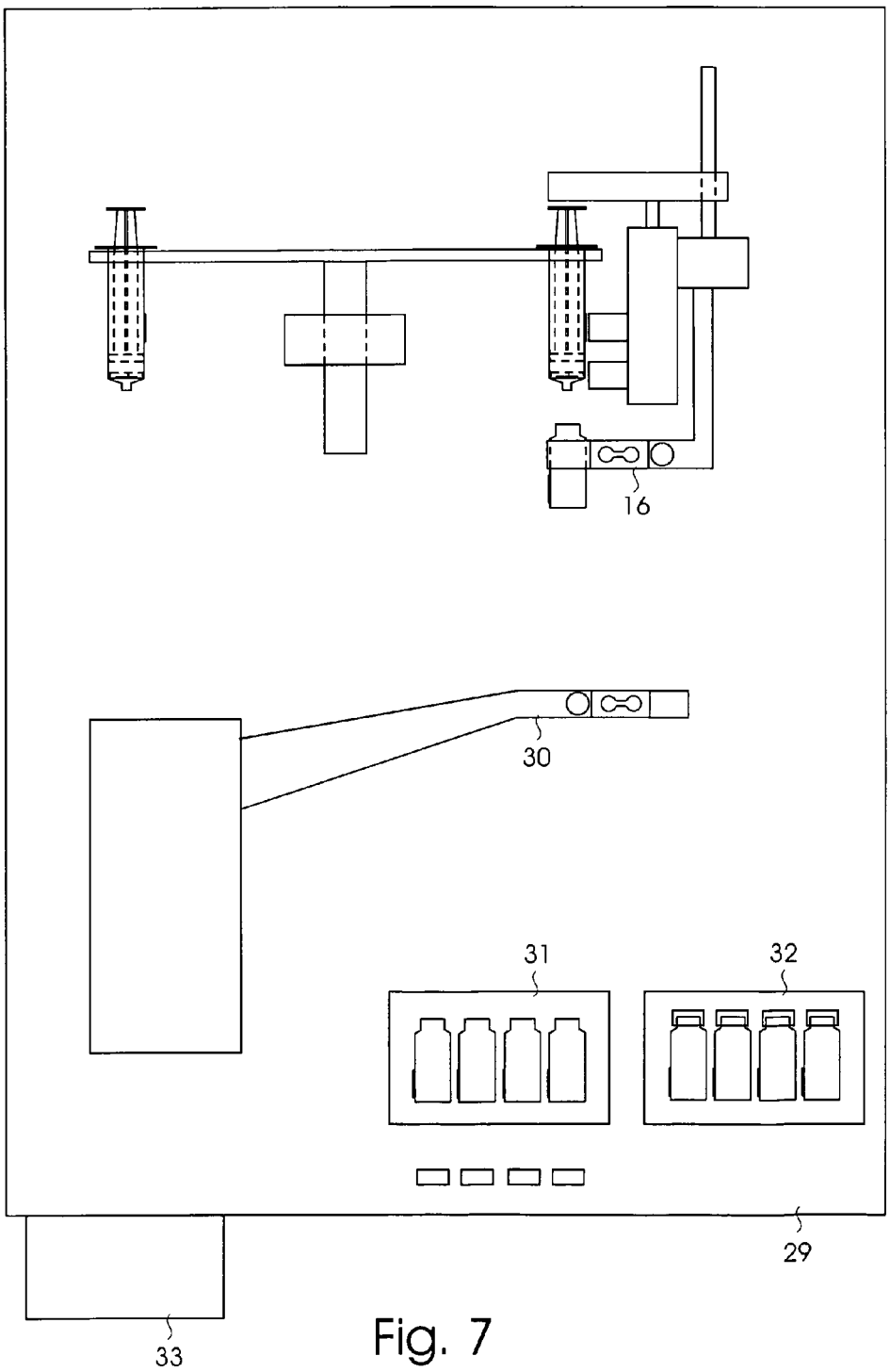

The invention will now be further explained with a reference to the following figures, in which:

FIG. 1A schematically shows a hypodermic syringe provided with a stirrer in side view;

FIG. 1B schematically shows a stirrer in top view;

FIG. 2 schematically shows a possible embodiment of an arrangement according to the invention in side view;

FIG. 3A schematically shows an arrangement with a circular store in top view;

FIG. 3B schematically shows an arrangement with a linear store in top view;

FIG. 4 schematically shows an alternative embodiment of an arrangement according to the invention in side view;

FIG. 5A schematically shows an alternative sub container in front view;

FIG. 5B schematically shows this sub container in side view;

FIG. 6 schematically shows an arrangement according to the invention with these alternative dispensers in side view;

FIG. 7 schematically shows an arrangement including a robot arm, a store and an input device.

FIG. 1A schematically shows a hypodermic syringe 1 provided with a stirrer in side view, with the aid of which components for preparations to be produced can be supplied. Hypodermic syringe 1 consists of a sub container 2, a piston 3, connected to a pressing part 4 and an outlet 5 that may be provided with a valve, not shown here. Sub container 2 comprises a component 6, usually a liquid in which substances are dissolved or present as an emulsion. In order to assure that component 6 is sufficiently homogeneous while making up a preparation, sub container 2 is provided with a stirrer 7, here a cross-shaped object made of plastic in which a permanent magnet is embedded which may start to rotate when a magnetic field is supplied. On sub container 2 a RF tag 8 is attached, well known in the field, into which data can be stored, which data can be read with the aid of a RF field and changed if desired. In the RF tag connected to sub container 2, data relating to component 6 are stored for example. FIG. 1B schematically shows a stirrer 7 in top view, provided with a magnetic bar 9.

FIG. 2 schematically shows a possible embodiment of an arrangement according to the invention in side view, consisting of an arm 10 onto which a linear motor 11 is connected with which a pressing finger 12 can be operated which can push in a pressing part 4 of a hypodermic syringe 1 until a previously determined amount of a component present in hypodermic syringe 1 is discharged. Arm 10 is connected to a drive 13 with which pressing finger 12 can be placed above a pressing part 4 of a selected hypodermic syringe. Onto arm 10 an auxiliary arm 14 is connected, on the end of which a container 15 is clamped with the aid of a clamp 16, in such a way that container 15 always collects the component dispensed by a hypodermic syringe. The hypodermic syringes containing the different components can be placed in a circular store, in which case drive 13 is a rotating motor. The hypodermic syringes may also be placed in a linear store, in which case drive 13 is a linear motor. While making up a preparation, pressing finger 12 and container 15 are placed above and below a selected hypodermic syringe respectively. In this embodiment, each hypodermic syringe is provided with an RF tag 8, in which data about the component present in the hypodermic needle is written, like the composition and the amount still remaining. Before linear motor 11 is switched on, a reading device 17 checks if the right hypodermic syringe is positioned above container 15 and if the amount of component, present in the hypodermic syringe is sufficient. If this is the case than the desired amount is dispensed. Container 15 is also provided with an RF tag 18, into which for example the composition of the preparation can be written when filled, with the aid of a writing device 19. Moreover a set of coils 20 is connected to linear motor 11, with the aid of which stirrer 7 can be made to rotate in a manner well known as such, before linear motor 11 is switched on. The actual dosage takes place by moving pressing finger 12 with the aid of linear motor 11 over a given distance, but it is also possible to provide for example clamp 16 with a load cell 21, well known in the art, with which the dispensed amount of the component can be determined by weighing.

FIG. 3A schematically shows an arrangement with a circular store 22 in top view, filled with hypodermic syringes 1. A rotating motor 13 positions arm 10 and linear motor 11 in such a way that pressing finger 12 is situated above a hypodermic syringe and container 15 (not visible in the figure) is situated below it, after which linear motor 11 presses out the desired amount of the component present in the hypodermic syringe. FIG. 3B schematically shows an arrangement with a linear store 23 in top view, filled with hypodermic syringes 1. A linear motor 13 positions arm 10 and linear motor 11 in such a way that pressing finger 12 is situated above a hypodermic syringe and container 15 (not visible in the figure) is situated below it, after which linear motor 11 presses out the desired amount of the component present in the hypodermic syringe.

FIG. 4 schematically shows an alternative embodiment of an arrangement according to the invention in side view, with a rigidly mounted linear motor 11 with which a pressing finger 12 can be operated which can push in a pressing part 4 of a hypodermic syringe 1 until a previously determined amount of a component present in hypodermic syringe 1 is discharged. Below the hypodermic syringe a container 15 is connected via a clamp 16 and an auxiliary arm 14 to linear motor 11, in such a way that container 15 is positioned precisely below the hypodermic syringe. In this embodiment a number of hypodermic syringes 1 is placed in a circular store 22, that can be rotated with the aid of a rotating motor 13 until a selected hypodermic syringe is positioned above container 15. Before linear motor 11 is switched on, a reading device 17 checks if the right hypodermic syringe is selected and the set of coils 20 is switched on, with which stirrer 7 can be made to rotate in a well known manner. The actual dosage takes place by moving pressing finger 12 with the aid of linear motor 11 over a given distance, but it is also possible to provide for example clamp 16 with a load cell 21, well known in the art, with which the dispensed amount of the component can be determined by weighing. It will be clear that the embodiment shown here can be realised with a linear store as well, in which case for motor 13 a linear motor must be chosen.

FIG. 5A schematically shows an alternative sub container in front view, consisting of a storage bag, for example an infusion bag 23, to which an actuator 24 is coupled, as such well known in the art, comprising a solenoid 25 of which the core 26 in a rest position blocks a tube 27 connected to infusion bag 23, in such a way that when a short current pulse is supplied to solenoid 25, a small amount of the component present in infusion bag 23 is discharged. FIG. 5B schematically shows this sub container in side view, with infusion bag 23, actuator 24 and tube 27.

FIG. 6 schematically shows an arrangement according to the invention with this alternative dispenser in side view, consisting of an arm 10 to which a support plate 28 is connected, onto which a number of storage bags 23 is attached, together with actuators 24 coupled to it. Operationally, container 15 is positioned precisely below an actuator that is to be excited, in which case a previously amount is dispensed by this actuator of the component present in the storage bag 23 coupled to this actuator, so that it can flow into container 15. Arm 10 is connected to a drive 13 with which support plate 28 can be moved in a direction perpendicular to the plane of the figure, until a selected actuator 24 is positioned above container 15. To arm 10, an auxiliary arm 14 connected, on the end of which container 15 is clamped in with a clamp 16, in such a way that container 15 always collects the component dispensed by an actuator 24. Preferably, for example clamp 16 is provided with a load cell 21, well known in the art, so that the amount of component withdrawn from storage bag 23 can be determined precisely. Of course it is also possible to move auxiliary arm 14 with drive 13, in which case support plate 28 may be rigidly mounted. In the embodiment shown here, drive 13 is a linear motor, but the supply bags 23 filled with the different components can also be placed in a circular store, in which case support plate 28 is circularly shaped and drive 13 is a rotating motor. Moreover, each storage bag 23 is provided with an RF tag 8, in which data concerning the components present in the respective storage bag 23 is written, like the composition and the remaining amount. Before actuator 24 is excited, a reading device 17 connected to auxiliary arm 14 is used to check if the correct storage bag 23 is positioned above container 15 and if sufficient component is present. This being the case, the desired component is dispensed, until it is determined with the aid of load cell 21 that the right amount has been dispensed. Container 15 is also provided with an RF tag 18, in which the composition of the preparation can be written after being filled, with the aid of a writing device 19.

FIG. 7 schematically shows an arrangement, placed inside a housing 29, together with a robot arm 30, which can pick up empty containers from a store 31 and place them in clamp 16 and which can provide them with a cap and subsequently put them in a store 32 after these containers haven been filled. Moreover an input device 33 is shown, in this embodiment a computer, with which the composition of the preparations can be entered and with which the various checks can be performed.

Before a production sequence starts, filled hypodermic syringes or storage bags with an aseptic content are picked up from an aseptic coupling lock, docked to the housing, and put into store 31, as well as aseptic containers and caps, after which the production sequence may start. After finishing the production sequence, the containers are picked up from store 32 and put into a coupling lock docked to the housing. It is also possible to use a docked coupling lock as a combined store, in which case this coupling lock takes over the function of stores 31, 32.

Housing 29 is preferably provided with a cross flow system, as such well known in the art, by which filtered, aseptic air is guided through the arrangement in such a direction that cross-contamination can be practically excluded.

The invention claimed is:

1. Method for filling a container with a preparation consisting of a number of liquid components, characterized in that the components are stored in a series of sub containers, that on the basis of a supplied prescription a robot subsequently selects subcontainers wherein each subcontainer has an identification label attached and the robot reads the identification label with the aid of a reading device before the actuator is actuated, containing the components mentioned in the prescription and, by making use of an actuator, dispense an amount of a component from a selected sub container as specified by the prescription into the container and after the actuator has been actuated the robot writes data to the corresponding identification label with a writing device.

2. A method according to claim 1, characterized in that to each container an identification label is attached and that after making up the preparation the robot writes an identification to the identification label with the writing device.

3. A method according to claim 2, characterized in that each container is weighed while being filled and/or after being filled.

4. A method according to claim 1, characterized in that after making up a number of preparations, the content of the sub containers is read with the aid of the reading device and compared with the content of the sub containers as expected by the robot.

5. A method according to claim 1, characterized in that the sub container is a hypodermic syringe, that the actuator is a pressing device and that before the actuator is actuated a stirring mechanism, present inside the hypodermic syringe is put into action.

6. An arrangement according to claim 5, characterized in that the robot is provided with a weighing device, for determining a weight of a container.

7. An arrangement according to claim 5, characterized in that a sub container is a hypodermic syringe and the actuator comprises a pressing device.

8. An arrangement according to claim 7, characterized in that the arrangement is provided with drive means for a stirring device and that at least some of the hypodermic syringes are provided with a stirring device.

9. An arrangement for making up preparations, comprising a number of sub containers, filled with liquid components for the preparations and at least one container for receiving the components, characterized in that the arrangement is accommodated inside a closed housing and is provided with at least one actuator for dispensing components of the sub-containers into the at least one container, and further comprises a robot for operating the at least one actuator and for placing a container under an outlet of an actuator or for placing an outlet from an actuator above a container, and that the subcontainers and the at least one container are each provided with an identification label and that the robot is provided with a reading device for reading an identification label and a writing device for writing onto an identification label.

10. An arrangement according to claim 9, characterized in that the robot is provided with an input device with which a list of components for a container can be entered.

* * * * *